US010891910B2

(12) United States Patent
Yeh

(10) Patent No.: US 10,891,910 B2
(45) Date of Patent: Jan. 12, 2021

(54) LIQUID CRYSTAL DISPLAY DEVICE

(71) Applicant: HIMAX TECHNOLOGIES LIMITED, Tainan (TW)

(72) Inventor: Wei-Hsien Yeh, Tainan (TW)

(73) Assignee: HIMAX TECHNOLOGIES LIMITED, Tainan (TW)

( * ) Notice: Subject to any disclaimer, the term of this patent is extended or adjusted under 35 U.S.C. 154(b) by 0 days.

(21) Appl. No.: 16/398,296

(22) Filed: Apr. 30, 2019

(65) Prior Publication Data

US 2020/0152146 A1 May 14, 2020

Related U.S. Application Data

(60) Provisional application No. 62/759,999, filed on Nov. 12, 2018.

(51) Int. Cl.
*G09G 3/36* (2006.01)
*G09G 3/34* (2006.01)

(52) U.S. Cl.
CPC ..... *G09G 3/3614* (2013.01); *G09G 3/3677* (2013.01); *G09G 3/3688* (2013.01); *G09G 3/3406* (2013.01); *G09G 2300/0809* (2013.01); *G09G 2330/021* (2013.01)

(58) Field of Classification Search
CPC .. G09G 3/3614; G09G 3/3677; G09G 3/3688; G09G 3/3406; G09G 2300/0809; G09G 2330/021; G09G 2310/0251
See application file for complete search history.

(56) References Cited

U.S. PATENT DOCUMENTS

| | | | | |
|---|---|---|---|---|
| 7,468,720 | B2 | 12/2008 | Kim | |
| 2002/0036606 | A1* | 3/2002 | Ichikawa | H01L 27/092 345/87 |
| 2012/0013596 | A1* | 1/2012 | Kim | G09G 3/3648 345/212 |
| 2012/0162183 | A1* | 6/2012 | Kwon | G09G 3/3614 345/212 |
| 2015/0062189 | A1* | 3/2015 | Hwang | G09G 3/3648 345/690 |

FOREIGN PATENT DOCUMENTS

CN 1184261 6/1998

OTHER PUBLICATIONS

"Office Action of Taiwan Counterpart Application," dated Jan. 17, 2020, p. 1-p. 4.

* cited by examiner

*Primary Examiner* — Brent D Castiaux
(74) *Attorney, Agent, or Firm* — JCIPRNET

(57) ABSTRACT

A liquid crystal display device is provided. A sub-pixel unit includes a liquid crystal capacitor, a storage circuit, and a switching circuit. The storage circuit is configured to store, in a scanning period of the frame period, a data driving signal provided by a data line and provide the data driving signal to the liquid crystal capacitor in a display period of the frame period. The switching circuit is configured to be turned on in the scanning period to provide a reference voltage to the liquid crystal capacitor.

9 Claims, 3 Drawing Sheets

LIQUID CRYSTAL DISPLAY DEVICE

CROSS-REFERENCE TO RELATED APPLICATION

This application claims the priority benefit of U.S. provisional application Ser. No. 62/759,999, filed on Nov. 12, 2018. The entirety of the above-mentioned patent application is hereby incorporated by reference herein and made a part of this specification.

BACKGROUND

1. Field of the Invention

The present disclosure relates to a display device, and in particular, to a liquid crystal display device.

2. Description of Related Art

Because of the characteristics of liquid crystals, when a liquid crystal display displays a picture, a positive voltage and a negative voltage need to be frequently alternately applied to liquid crystal molecules, so that polarities of the liquid crystals are reversed to display grayscale data. In this way, the problem that liquid crystal molecules cannot rotate in response to the change in electric field after a fixed voltage is applied to the liquid crystal molecules for an unduly long time can be avoided, and display quality can be improved. However, when polarities are reversed, a data driving signal requires a broad operating voltage range, and an equivalent resistance generated when the liquid crystal molecules are driven is also large, leading to unnecessary power consumption.

In the conventional technology, a pixel circuit including eight transistors and two capacitors may be used to alleviate the power consumption problem caused by reversal of polarities. However, for this method, the circuit area is too large. Therefore, there is still room for improvement of the pixel circuit of the liquid crystal display.

SUMMARY OF THE INVENTION

The present disclosure provides a liquid crystal display device, to effectively alleviate the power consumption problem and reduce the circuit area.

The liquid crystal display device in the present disclosure includes a gate driver, a source driver, and a liquid crystal display panel. The liquid crystal display panel is coupled to the gate driver and the source driver. The liquid crystal display panel includes a plurality of sub-pixel units, and each sub-pixel unit includes a liquid crystal capacitor, a storage circuit, and a switching circuit. A first end of the liquid crystal capacitor is coupled to a common voltage. The storage circuit is coupled between a data line and a second end of the liquid crystal capacitor, and is configured to store, in a scanning period of a frame period, a data driving signal provided by the data line, and provide the data driving signal to the liquid crystal capacitor in a display period of the frame period. The switching circuit is coupled to the liquid crystal capacitor and a reference voltage and is configured to be turned on in the scanning period to provide the reference voltage to the liquid crystal capacitor.

In an embodiment of the present invention, the storage circuit includes: a first switch, a storage capacitor, and a second switch. A first end of the first switch is coupled to the data line, a control end of the first switch is coupled to the gate driver, and the first switch is in an on state in the scanning period and is in an off state in the display period. A first end and a second end of the storage capacitor are respectively coupled to a second end of the first switch and ground. The second switch is coupled between the first end of the storage capacitor and the second end of the liquid crystal capacitor, a control end of the second switch is coupled to the gate driver, and the second switch is in an off state in the scanning period and is in an on state in the display period.

In an embodiment of the present invention, the switching circuit includes: a third switch, coupled between the reference voltage and the second end of the liquid crystal capacitor, the third switch being in an on state in the scanning period and being in an off state in the display period.

In an embodiment of the present invention, the first switch, the second switch, and the third switch are transmission gates.

In an embodiment of the present invention, the reference voltage enables the liquid crystal capacitor to display a preset picture in the scanning period.

In an embodiment of the present invention, a polarity of the common voltage is opposite to a polarity of the data driving signal.

In an embodiment of the present invention, a polarity of the common voltage is opposite to a polarity of the reference voltage.

In an embodiment of the present invention, the liquid crystal display device further includes a backlight module, configured to provide a backlight source in the display period.

In an embodiment of the present invention, the liquid crystal display panel includes a plurality of pixels, and each pixel includes a plurality of sub-pixel units.

Based on the above, the storage circuit in the embodiments of the present disclosure may store, in the scanning period of the frame period, the data driving signal provided by the data line and provide the data driving signal to the liquid crystal capacitor in the display period of the frame period, and the switching circuit may be turned on in the scanning period to provide the reference voltage to the liquid crystal capacitor. In this way, the sub-pixel unit may not need to be driven in the entire frame period, to effectively reduce power consumption of the liquid crystal display device and reduce the circuit area.

In order to make the foregoing features and advantages of the present disclosure more comprehensible, embodiments are described in detail below with reference to the accompanying drawings.

DESCRIPTION OF THE EMBODIMENTS

Figure 1:
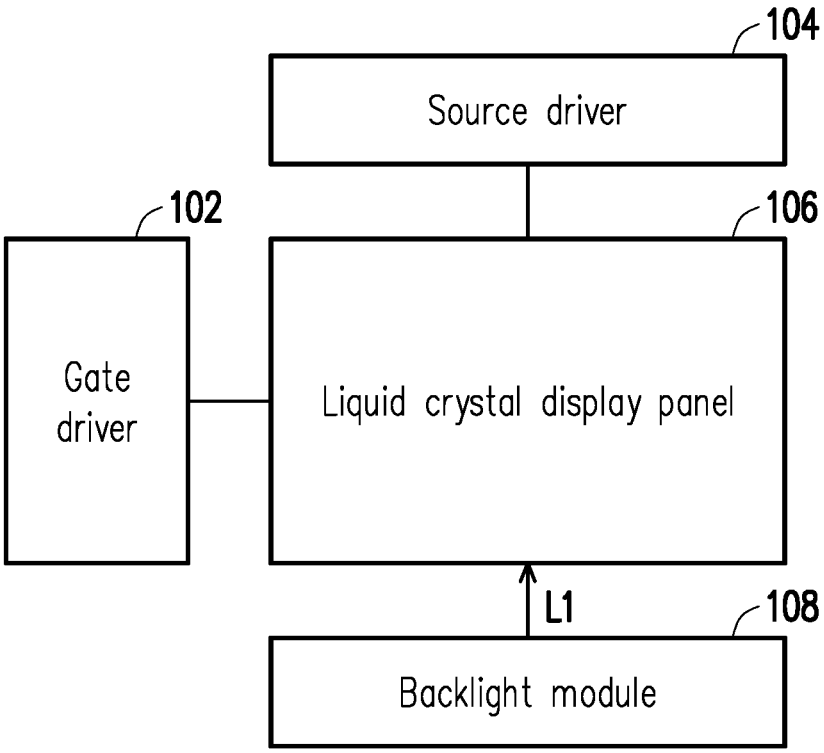
FIG. 1 is a schematic diagram of a liquid crystal display device according to an embodiment of the present invention.

FIG. 1 is a schematic diagram of a liquid crystal display device according to an embodiment of the present invention. Referring to FIG. 1, the liquid crystal display device may include a gate driver 102, a source driver 104, a liquid crystal display panel 106, and a backlight module 108. The liquid crystal display panel 106 is coupled to the gate driver 102 and the source driver 104.

The liquid crystal display panel 106 may include a plurality of pixels (not shown). Each pixel may include a plurality of sub-pixel units, for example, include a red sub-pixel unit, a green sub-pixel unit, and a blue sub-pixel unit that are used to display different colors, but is not limited thereto. The gate driver 102 and the source driver 104 may respectively provide a gate driving signal and a source driving signal to a transistor switch corresponding to the sub-pixel unit, to turn on the transistor switch to charge the sub-pixel unit to a required grayscale voltage value.

Figure 2:
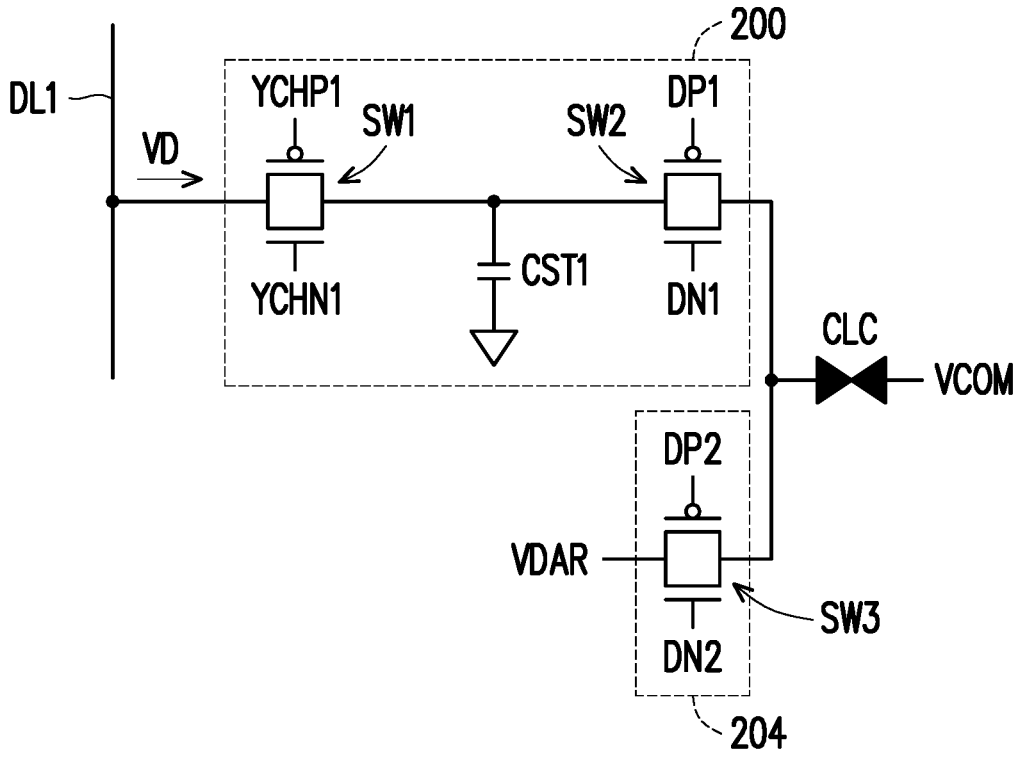
FIG. 2 is a schematic diagram of a sub-pixel unit according to an embodiment of the present invention.
Figure 3:
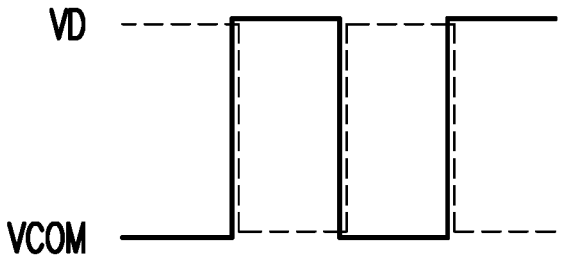
FIG. 3 is a schematic waveform diagram of a data driving signal and a common voltage according to an embodiment of the present invention.

Further, the foregoing sub-pixel unit may include a liquid crystal capacitor CLC, a storage circuit 200, and a switching circuit 204 as shown in FIG. 2. A first end of the liquid crystal capacitor CLC is coupled to a common voltage VCOM. The storage circuit 200 is coupled between a data line DL1 corresponding to the sub-pixel unit and a second end of the liquid crystal capacitor CLC. The switching circuit 204 is coupled between the second end of the liquid crystal capacitor CLC and a reference voltage VDAR. The storage circuit 200 may be configured to store, in a scanning period of the frame period, a data driving signal VD provided by the data line DL1 and provide the data driving signal VD to the liquid crystal capacitor CLC in a display period of the frame period. A polarity of the data driving signal VD may be, for example, opposite to that of the common voltage VCOM, as shown in FIG. 3. In this way, voltage change amplitude of the data driving signal VD can be reduced, to reduce power consumption. The backlight module 108 may be configured to provide a backlight source L1 in the display period of the frame period, to provide light require for the liquid crystal display panel 106 to display a picture. In addition, the switching circuit 204 may be configured to be turned on in the scanning period to provide the reference voltage VDAR to the liquid crystal capacitor. The reference voltage VDAR is used to enable the liquid crystal capacitor CLC to display a preset picture (which is, for example, a black picture but is not limited thereto) in the scanning period. In some embodiments, the reference voltage VDAR may have a polarity opposite to that of the common voltage VCOM.

For example, in the embodiment of FIG. 2, the storage circuit 200 may include a switch SW1, a switch SW2, and a storage capacitor CST1, and the switching circuit 204 may include a switch SW3. The switch SW1 is coupled between the data line DL1 and a first end of the storage capacitor CST1. A control end of the switch SW1 is coupled to the gate driver 102. A second end of the storage capacitor CST1 is coupled to ground. The switch SW2 is coupled between the second end of the storage capacitor CST1 and the liquid crystal capacitor CLC. A control end of the switch SW2 is coupled to the gate driver 102. The switch SW3 is coupled between reference voltage VDAR and the liquid crystal capacitor CLC. A control end of the switch SW3 is coupled to the gate driver 102. The switches SW1 to SW3 may be, for example, respectively implemented by transmission gates composed of a P-type transistor and an N-type transistor but are not limited thereto, and may alternatively be implemented by a single transistor. In the embodiment of FIG. 2, the on state of the switch SW1 is controlled by control signals YCHP1 and YCHN1, the on state of the switch SW2 is controlled by control signals DP1 and DN1, and the on state of the switch SW3 is controlled by control signals DP2 and DN2.

Figure 4:
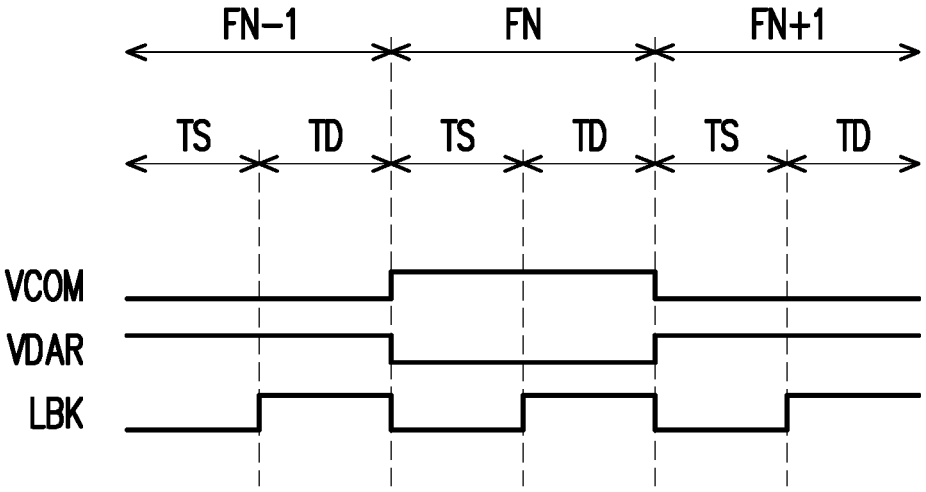
FIG. 4 is a schematic waveform diagram of a common voltage, a reference voltage, and a driving signal of a backlight module according to an embodiment of the present invention.

Waveforms of the common voltage VCOM, the reference voltage VDAR, and the driving signal LBK of the backlight module 108 in the embodiment of FIG. 2 may be, for example, shown in FIG. 4. In the embodiment of FIG. 4, one half period of each frame period (for example, frame period FN−1, FN, or FN+1) serves as the scanning period TS, and the other half period serves as the display period TD. However, the present disclosure is not limited thereto. In other embodiments, the scanning period and the display period may alternatively have different proportional relationships. In this embodiment, the data driving signal VD provided by the data line DL1 in the frame period FN−1 or FN+1 is positive, and the data driving signal VD provided in the frame period FN is negative. The common voltage VCOM in the embodiment of FIG. 4 may be correspondingly at a low voltage level in the frame period FN−1 or FN+1, and the reference voltage VDAR may be correspondingly at a high voltage level. In addition, the frame period FN and the common voltage VCOM are correspondingly at a high voltage level, and the reference voltage VDAR is correspondingly at a low voltage level.

In the scanning period TS of the frame period FN−1, the gate driver 102 may control the switches SW1 and SW3 to be in an on state and the switch SW2 to be in an off state. In this way, the data driving signal VD provided by the data line DL1 may be stored to the storage capacitor CST1 through the switch SW1. On the other hand, the reference voltage VDAR may be provided to the liquid crystal capacitor CLC through the switch SW3, so that the liquid crystal capacitor CLC displays a preset picture (for example, a black picture). In addition, the driving signal LBK is at the low voltage level. Therefore, the backlight module 108 does not provide the backlight source L1 in the scanning period TS.

In the display period TD of the frame period FN−1, the gate driver 102 may control the switches SW1 and SW3 to be in an off state and the switch SW2 to be in an on state. In this way, the reference voltage VDAR stops being provided to the liquid crystal capacitor CLC, and the data driving signal VD stored in the storage capacitor CST1 may be provided to the liquid crystal capacitor CLC in the scanning period TD, so that the liquid crystal capacitor CLC displays a corresponding picture.

Similarly, the liquid crystal capacitor CLC may be driven in the frame period FN in a similar manner to display a picture, and a difference merely lies in that polarities are different (the data driving signal VD is negative in the frame period FN). A person of ordinary skill in the art can derive implementations thereof according to content of the foregoing embodiments. Therefore, the implementations are not described herein again.

In this way, the data line DL1 is driven in only a part of the frame period to provide the data driving signal VD, and the data line DL1 may not need to be driven in the entire frame period, unlike that in the conventional technology, thereby further alleviating the power consumption problem. In addition, this embodiment uses only six transistors and one capacitor to drive the liquid crystal capacitor CLC for polarity reversal, to reduce the circuit area.

Figure 5:
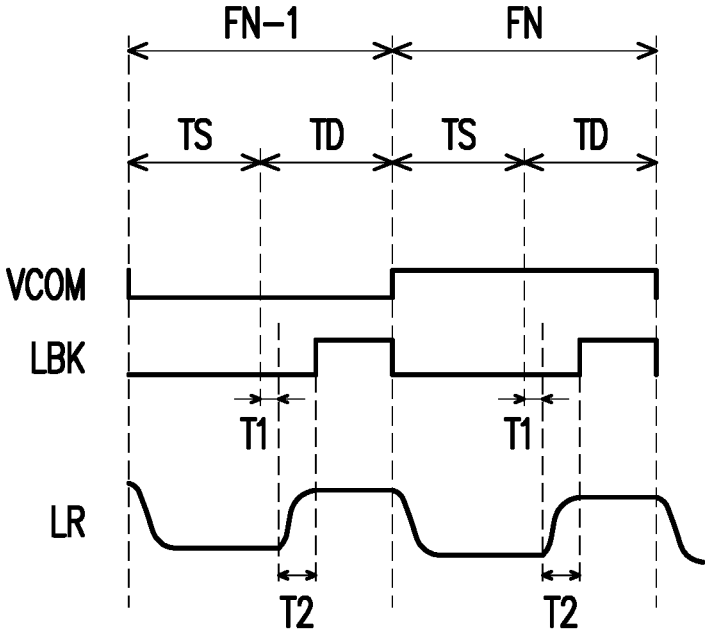
FIG. 5 is a schematic waveform diagram of a common voltage, a driving signal of a backlight module, and an optical response of a liquid crystal capacitor according to an embodiment of the present invention.

It should be noted that in some embodiments, the backlight module 108 may not need to provide the backlight source L1 in the entire display period TD. As shown in FIG. 5, after entering the display period TD, the storage capacitor CST1 may start to provide the data driving signal VD to the liquid crystal capacitor CLC. After a time T1, a voltage at the second end of the liquid crystal capacitor CLC is charged to a voltage corresponding to the data driving signal VD. It can be known from an optical response waveform LR of the liquid crystal capacitor CLC that liquid crystal molecules in the liquid crystal capacitor CLC can rotate to a position of the voltage corresponding to the data driving signal VD only after a time T2. Therefore, the driving signal LBK is at a high voltage level at a time point at which the time T2 ends, so that the backlight module 108 starts to provide the backlight source L1. Thus, the power consumption problem can be further alleviated.

Based on the above, the storage circuit in the present disclosure may store, in the scanning period of the frame period, the data driving signal provided by the data line and provide the data driving signal to the liquid crystal capacitor in the display period of the frame period, and the switching circuit may be turned on in the scanning period to provide the reference voltage to the liquid crystal capacitor. In this way, the sub-pixel unit may not need to be driven in the entire frame period, to effectively reduce power consumption of the liquid crystal display device and reduce the circuit area. For example, in some embodiments, only six transistors and one capacitor are used to drive the liquid crystal capacitor for polarity reversal and reduce power consumption, to effectively reduce the circuit area.

Although the present disclosure is disclosed as above by using the embodiments, the embodiments are not intended to limit the present invention. A person of ordinary skill in the art may further make variations and improvements without departing from the spirit and scope of the present invention. Therefore, the protection scope of the present disclosure should be subject to the appended claims.

What is claimed is:

1. A liquid crystal display device, comprising:

a gate driver;

a source driver; and a liquid crystal display panel, coupled to the gate driver and the source driver, wherein the liquid crystal display panel comprises a plurality of sub-pixel units, and each sub-pixel unit comprises:

a liquid crystal capacitor, wherein a first end of the liquid crystal capacitor is coupled to a common voltage;

a storage circuit, comprising:

a first switch, wherein a first end of the first switch is coupled to the data line;

a storage capacitor, wherein a first end and a second end of the storage capacitor are respectively coupled to a second end of the first switch and ground; and a second switch, coupled between the first end of the storage capacitor and a second end of the liquid crystal capacitor; and a switching circuit, comprising:

a third switch, coupled between a reference voltage and the second end of the liquid crystal capacitor, wherein, during a scanning period of a frame period, the first switch and the third switch are turned on and the second switch is turned off, and during a display period of the frame period, the first switch and the third switch are turned off and the second switch is turned on.

2. The liquid crystal display device according to claim 1, wherein a control end of the first switch is coupled to the gate driver, and the first switch is in an on state in the scanning period and is in an off state in the display period; and a control end of the second switch is coupled to the gate driver, and the second switch is in an off state in the scanning period and is in an on state in the display period.

3. The liquid crystal display device according to claim 2, wherein the third switch is in an on state in the scanning period and is in an off state in the display period.

4. The liquid crystal display device according to claim 3, wherein the first switch, the second switch, and the third switch are transmission gates.

5. The liquid crystal display device according to claim 1, wherein the reference voltage enables the liquid crystal capacitor to display a preset picture in the scanning period.

6. The liquid crystal display device according to claim 1, wherein a polarity of the common voltage is opposite to a polarity of the data driving signal.

7. The liquid crystal display device according to claim 1, wherein a polarity of the common voltage is opposite to a polarity of the reference voltage.

8. The liquid crystal display device according to claim 1, further comprising:

a backlight module, configured to provide a backlight source in the display period.

9. The liquid crystal display device according to claim 1, wherein the liquid crystal display panel comprises a plurality of pixels, and each pixel comprises a plurality of sub-pixel units.

* * * * *